US005080038A

United States Patent [19]

Rubin

[11] Patent Number: 5,080,038

[45] Date of Patent: Jan. 14, 1992

[54] EXTENDED NIP DEVELOPMENT APPARATUS HAVING A TRANSPORT ASSIST MAGNET

[75] Inventor: Bruce J. Rubin, Rochester, N.Y.

[73] Assignee: Eastman Kodak Company, Rochester, N.Y.

[21] Appl. No.: 720,031

[22] Filed: Jun. 24, 1991

[51] Int. Cl.[5] ..... G03G 15/09

[52] U.S. Cl. ..... 118/657; 355/251; 430/122

[58] Field of Search ..... 118/657, 658; 355/251, 355/245, 253; 430/122

[56] References Cited

U.S. PATENT DOCUMENTS

| | | | |
|---|---|---|---|
| 4,235,549 | 11/1980 | Eisbein et al. | 118/657 |
| 4,287,850 | 9/1981 | Yamamoto et al. | 118/657 |
| 4,638,759 | 1/1987 | Ville et al. | 118/657 |
| 4,707,107 | 11/1987 | Joseph | 355/253 |
| 4,838,200 | 6/1989 | Hosoi et al. | 118/658 |
| 4,928,145 | 5/1990 | Okamoto et al. | 355/245 |

FOREIGN PATENT DOCUMENTS 39406 9/1980 Japan .

*Primary Examiner*—A. T. Grimley
*Assistant Examiner*—Patrick J. Stanzione
*Attorney, Agent, or Firm*—Tallam I. Nguti

[57] ABSTRACT

A development apparatus for developing latent images on an image-bearing surface includes a magnetic core generating a first magnetic field, a non-magnetic shell surrounding and spaced from the magnetic core, and a transport assist magnet mounted at a desired spot between the non-magnetic shell and the magnetic core. The transport assist magnet generates a second magnetic field at and about the desired spot thereby creating a magnetic field strength gradient thereabout for assisting the magnetic transportation of magnetic developer material over the surface of the non-magnetic shell.

7 Claims, 2 Drawing Sheets

EXTENDED NIP DEVELOPMENT APPARATUS HAVING A TRANSPORT ASSIST MAGNET

CROSS-REFERENCE TO A RELATED APPLICATION

This application is related to U.S. application Ser. No. 07/719904, entitled DEVELOPMENT APPARATUS HAVING AN EXTENDED DEVELOPMENT NIP, filed in the name of Bruce J. Rubin on even data herewith.

BACKGROUND OF THE INVENTION

1. Field of the Invention

The present invention relates to electrostatographic development apparatus, and more particularly to such a development apparatus that includes a magnetic development brush which has an extended development nip.

2. Description Relative to the Prior Art

Development apparatus which include magnetic development brushes are well known for use in electrostatographic reproduction apparatus, such as copiers or printers. Such development apparatus which are used for developing latent images formed electrostatically on image-bearing surfaces in reproduction apparatus are disclosed, for example, in Japanese Patent No. Sho 55 (1980)-39406; U.S. Pat. No. 4,235,549 issued to Eisbein et al; 4,287,850 issued to Yamamoto et al.; and 4,928,145 issued to Okamoto et al.

As shown, the magnetic development brush of each of the disclosed development apparatus includes a generally cylindrical magnetic core and a generally cylindrical non-magnetic shell surrounding such core. When mounted for operation in a copier or printer, for example, the non-magnetic shell of the magnetic brush is located spaced from, and forms a development nip or footprint with the image-bearing surface of such a copier or printer. As further shown, the magnetic core of the magnetic brush functions to attract magnetic developer material contained within the development apparatus onto the surface of the non-magnetic shell thereof, thereby forming a developer material nap on such shell. Thereafter, the rotation of the magnetic core then causes such a developer material nap to move or be transported over the surface of the non-magnetic shell into and through the development nip where the developer material nap contacts and develops electrostatic latent images on the image-bearing surface.

The quality of the image so developed depends in significant part, for example, (a) on the nature, and height or thickness of the developer material nap being moved through the development nip; and (b) on the length of development time during which the latent images on the image-bearing surface are in desired contact with such a developer material nap. Such development time, at any given development apparatus speed, is determined of course by the size of the width or footprint of the development nip. As disclosed for example in the '549 patent to Eisbein and in the '850 patent to Yamamoto, such image development quality can be improved in part by providing means such as an extended shoulder section of the non-magnetic shell for increasing the width of the development nip, that is, for increasing the size of the nip width or footprint of the development nip, and thereby increasing the development time.

Unfortunately however, such an extended shoulder section will lie in an area significantly remote from the magnetic core such that it will have a weaker magnetic field strength relative to the rest of the areas of the non-magnetic shell. When such an extended development nip is formed in a generally horizontal orientation with the image-bearing surface, for example in a 6 o'clock position with a cylindrical image-bearing surface, the magnetic developer material nap must then move substantially vertically and against gravity in order to reach the extended shoulder section for example on an entrance side of such a nip. The consistency and desired thickness of the developer material nap has been found to be detrimentally affected during such substantially vertical movement. As a consequence, a consistent and desirably thick developer material nap, earlier formed at the base of the non-magnetic shell, may not efficiently reach and move around such an extended shoulder section in order to enter the extended development nip for quality image development.

SUMMARY OF THE INVENTION

It is therefore an object of the present invention to provide a magnetic brush development apparatus which has an extended development nip and means for effectively moving a consistent and desirably thick developer material nap around the magnetic brush thereof.

In accordance with the present invention, a development apparatus is provided for developing latent images on an image-bearing surface using magnetic developer material. The development apparatus comprises a housing and a magnetic development brush having a non-magnetic shell and a magnetic core consisting of a first magnetic member generating a first magnetic field about the non-magnetic shell. The non-magnetic shell defines a first space around the magnetic core and includes a first section, and a second, nip forming section for forming a development nip with an image-bearing surface.

The development apparatus also comprises means associated with the housing for supplying magnetic developer material to the first section of the non-magnetic shell of the magnetic development brush, and means associated with the magnetic development brush for causing the supplied magnetic developer material to be transported around the non-magnetic shell.

The development apparatus further comprises a transport assist member consisting of a second magnetic member that is mounted at a desired point within the first space defined by the non-magnetic shell about the magnetic core. The transport assist magnetic member generates a second magnetic field at and about such a desired point within the non-magnetic shell such that the second magnetic field creates a magnetic field strength gradient between such desired point and other locations within the non-magnetic shell for assisting the movement of magnetic developer material over the non-magnetic shell relative to such a desired point.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Elements not specifically shown or described herein are selectable from those known in the prior art.

Figure 1:
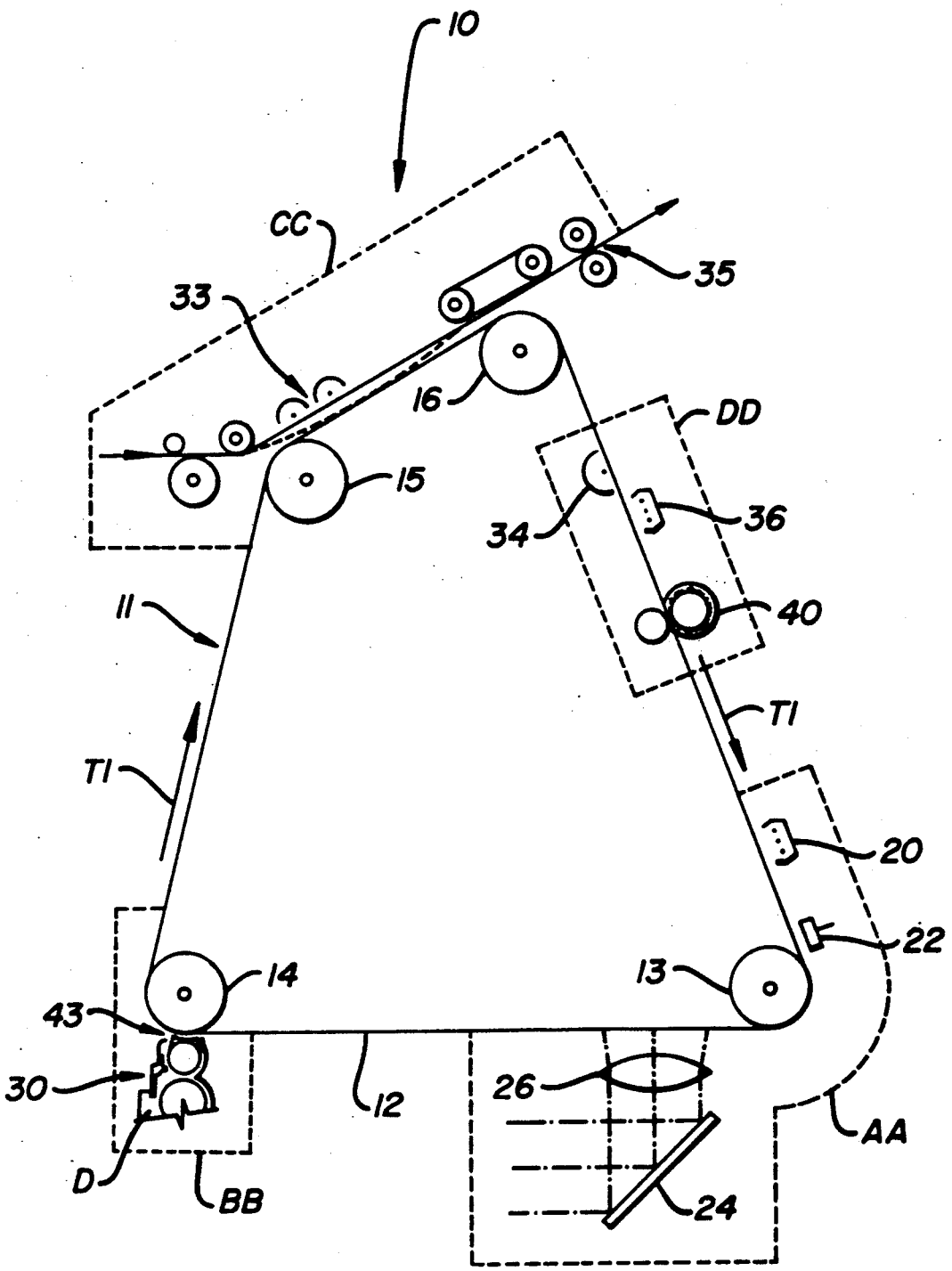
FIG. 1 is a schematic of an electrostatographic machine such as a copier or printer including the development apparatus of the present invention.

Referring now to FIG. 1, an electrostatographic reproduction apparatus, such as an optical copier, is shown generally as 10. The apparatus 10 includes an image-bearing member 11 which is an endless flexible photoconductive belt that has a frontside image-bearing surface 12. Although the member 11 is shown as an endless flexible web, it should be understood that an image-bearing member in the form of a rigid drum can also be used. The member 11, as shown, is trained about a series of rollers 13–16 for movement in the direction, for example, of the arrow T1. One of the rollers, such as the roller 13, can be a drive roller for repeatedly moving the member 11 so that its surface 12 maintains a fixed path, as shown, while being moved sequentially through a series of electrostatographic process stages shown, for example, as AA, BB, CC and DD.

As shown in FIG. 1, clean and charge-free portions of the image-bearing member 11 initially move through the stage AA where electrostatic charges and/or light, are used in one manner or another (as is well known in the art) to electrostatically form, on the surface 12, latent images of an original document. Typically, the stage AA includes components such as a primary charger 20 or other charge depositing component (not shown). The latent image of an original can thus be formed electrostatically on the surface 12, for example, by first uniformly charging the surface 12 to a suitable potential using the primary charger 20, and then imagewise discharging portions of such surface using, for example, an electronic printhead 22 or the like, and/or an optical system as shown partially. A typical optical system includes a light source (not shown) that illuminates a document sheet. The light rays reflected by a mirror such as 24 can then be reflected through a lens 26, and onto the surface 12 for such optical imaging.

The imaged portion of the image-bearing member 11 next moves to the stage BB where the latent image thereon is developed, that is, made visible, with charged particles of toner. Stage BB therefore includes a development apparatus, such as the development apparatus of the present invention, shown generally as 30. The development apparatus 30 of the present invention (to be described in detail below), for example, contains a two-component magnetic developer material D, that is comprised of magnetizable carrier particles, and of charged toner particles for developing the latent image on the surface 12 of member 11. During such development, the charged toner particles in the developer material D transfer to the image-bearing surface 12, and there adhere to the latent electrostatically formed image thereon, thereby making the image visible.

After such development, that portion of the image-bearing member 11 carrying the toner image thereon, then moves to the stage CC. The stage CC, as shown, includes an image transfer station 33 where the visible toner image on the surface 12 is transferred to a suitable receiver sheet, such as a sheet of plain paper, which is fed in registration to the station 33 along a sheet travel path. After such image transfer, the copy sheets then travels to a fusing station 35, as shown, where the toner image is permanently fused to the receiver sheet to form a hard copy.

Meanwhile, the used portion of member 11, from which the toner image was transferred, moves on towards the initial stage AA to again begin another imaging cycle. To ensure continued production of high quality hard copies during subsequent cycles of the above imaging process, each such used portion of the surface 12 must be cleaned before it is again reused. Such cleaning effectively removes any residual charges and residual particles remaining on the surface 12 following image transfer. Accordingly, such cleaning is carried out at the stage DD where residual charges are removed by a discharge lamp 34 and/or neutralized by a corona 36, for example, and residual particles are removed by a cleaning apparatus shown, for example, as 40.

Figure 2:
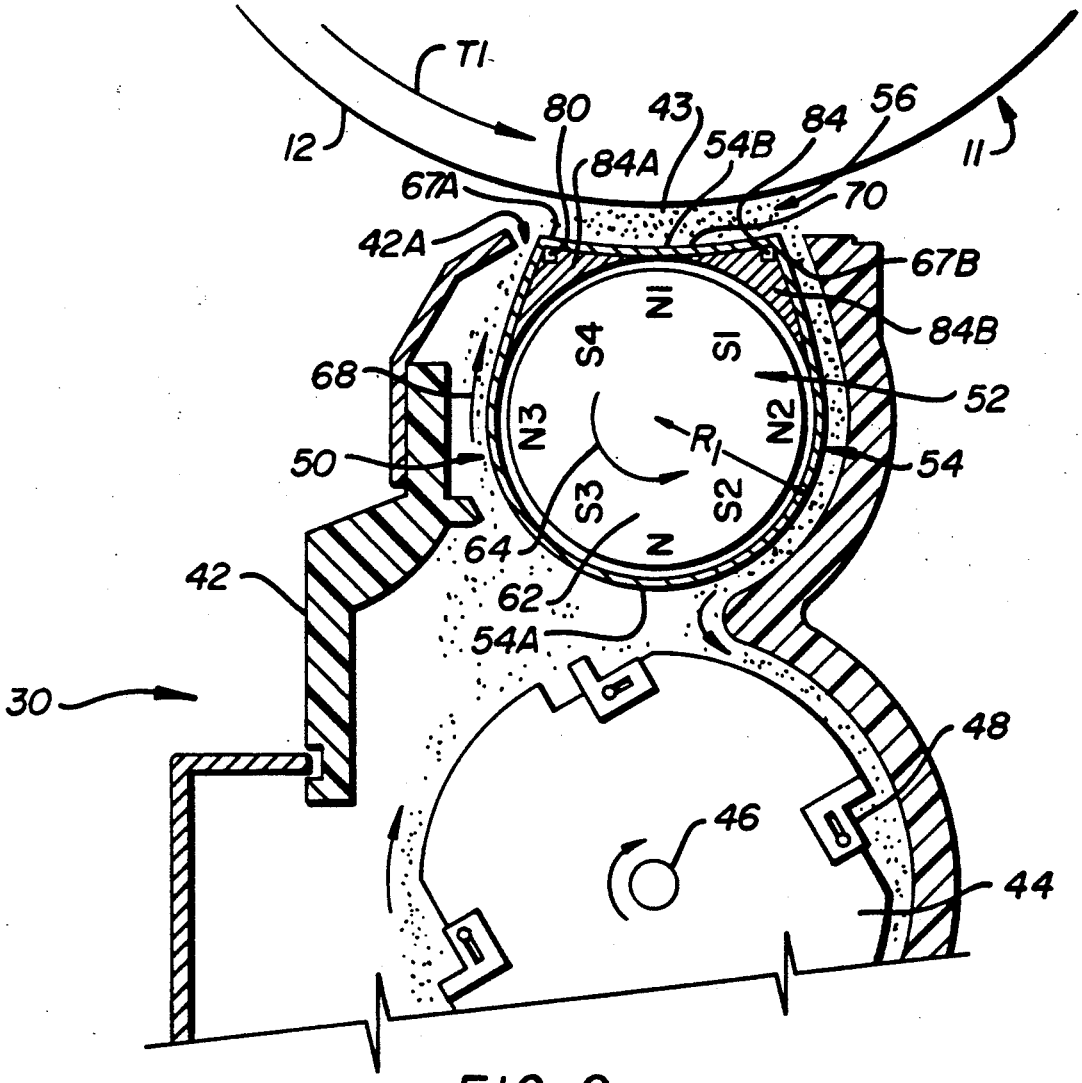
FIG. 2 is an end view, partly in section, of the development apparatus of FIG. 1 forming a generally horizontal or 6 o'clock position development nip, and including the transport assist magnet of the present invention.

Referring now to FIG. 2, part of the development apparatus 30 of the present invention is illustrated in greater detail. As shown, the development apparatus 30 includes a housing 42 which has a development opening 42A. The housing 42 is mountable within a segment, e.g. 43 (FIG. 1) along the fixed path of the image-bearing member 11 such that the development apparatus 30 forms a generally horizontal development nip with the image-bearing surface 12 of the member 11. In other words, the housing 42 is mounted such that the development apparatus 30 forms a 6 o'clock position development nip relative to the surface 12. Although the development apparatus 30 (FIG. 1) is shown mounted along a curved segment 43 of the fixed path of the surface 12, it is understood that for purposes of this invention the development apparatus 30 is equally adaptable for mounting along a flat segment of the fixed path of such surface 12.

Within the housing 42 of the development apparatus 30, means such as a ribbon blender assembly (not shown) can be mounted within a sump portion thereof for containing, mixing and moving the magnetic developer material D therein. An example of a ribbon blender is disclosed in U.S. Pat. No. 4,707,107 issued Nov. 17, 1987 in the name of Brian J. Joseph. The housing 42 also includes a developer material transport roller shown as 44 that is mounted for rotation for example about a shaft 46. The transport roller 44 can include a plurality of bucket members each shown as 48 for carrying developer material D about such roller 44 during rotation of the shaft and rollers 46, 44, respectively.

Still referring to FIG. 2, the development apparatus 30 further includes a magnetic development brush or roller designated generally as 50. As shown, the development brush or roller 50 includes a rotatable magnetic core 52 and a stationary non-magnetic shell 54. The magnetic development brush or roller 50 is mounted within the housing 42 so that a first portion 54A of the shell 54 is immediately adjacent the developer material transport roller 44, and such that a second, nip-forming portion 54B of the non-magnetic shell 54 projects beyond the housing 42 through the opening 42A. The development apparatus 30 is then mountable within a reproduction apparatus 10 so that the second portion 54B of the shell 54 which projects through the development opening 42A is slightly spaced from, and forms a development nip 56 with the surface 12 of the member 11. Mounted as such, the magnetic development brush or roller 50 can magnetically attract magnetic developer material D from the adjacent transport roller 44 onto the surface of the first portion 54A of the non-magnetic shell 54. With rotation of the core, the development brush 50 can then magnetically carry or transport such developer material from and over the first portion 54A into and through the development nip 56 where such developer material can contact and develop latent images on the surface 12.

As shown, the rotatable magnetic core 52 of the development brush 50 consists of a first magnetic member that includes a series of alternating pole permanent magnets 62 which are concentrically arranged thereabout. The magnets 62 each generates a first magnetic field that has a first magnetic strength region, for example the region having a radius R1 about the core 52, which exhibits a desired magnetic strength about such magnetic core 52. The desired magnetic field strength within this first region with radius R1 should be sufficient to produce a magnetic developer material nap on the surface of the non-magnetic shell which has a desired consistency and thickness for quality image development. As is known, rotation of the alternating pole magnets 62 of the core 52 in one direction, for example counterclockwise as shown by the arrow 64, will cause magnetic developer material on the surface of the non-magnetic shell 54 to move in the opposite direction.

Referring still to FIG. 2, the stationary non-magnetic shell 54 of the development brush 50 defines a first space around the core 52 and includes the first portion 54A, and the second, nip forming such portion 54B. As shown, the development brush 50 is mounted within the housing 42 such that the first portion 54A is located immediately adjacent the developer material transport roller 44 within the first magnetic strength region of the first magnetic field of the core magnets 62 in order to easily attract magnetic developer material thereto. The shape of the first portion 54A is shown as being generally cylindrical, having the radius R1, but it can be any shape suitable for effectively receiving developer material from the buckets 48 of the transport roller 44 under the magnetic influence of the core magnets 62.

As further shown, the second, nip-forming portion 54B of the non-magnetic shell 54 includes at least one of a pair of shoulder sections 67A, 67B which extend to a remote distance beyond the radius R1, and hence beyond the first magnetic strength region of the first magnetic field of the core 52. The shoulder sections 67A, 67B thus extend each respective (entrance and exit) side of the development nip 56 beyond the first magnetic strength region of the first magnetic field of the magnets 62. Each of the shoulder sections 67A and 67B has a surface 70 that is contoured or shaped to externally follow the shape or contour of the fixed path of the surface 12, for example within the segment 43 (FIG. 1). The fixed path of the surface 12 can be substantially flat, or as shown, it can be curved within such segment 43 (FIG. 1). Accordingly, as shown in FIG. 2, the shoulder sections 67A, 67B of the second portion 54B should each have a generally curved outer surface 70 that is spaced from, but follows the curved path of the surface 12 from one side to the other of the extended development nip 56.

In the development apparatus 30 of the present invention, developer material D containing magnetic or magnetizable carrier particles is moved by the transfer roller 44, using the buckets 48, into the magnetic attraction of the magnets 62 of the brush 50. There the magnetic developer material D is attracted onto the outside surface of the first portion 54A of the shell 54. As is known, the attracted magnetic developer material D forms a brush-like nap thereon, which should have a desired thickness or height sufficient for high-quality image development. As is known, at any point on the surface of the shell 54, the actual thickness and nature of such a magnetic developer material nap will depend significantly on the strength of magnetic field at and about such a point. For example, a stronger than average magnetic field at a particular point will result in a thicker than average magnetic developer material nap, and a weaker than average magnetic field will result in a nap that is thinner than average.

As pointed out above, rotation of the magnets 62 of the core 52 in one direction as shown, for example, will cause the brush-like nap of the magnetic developer material D on the shell 54 to move in the opposite direction, as shown for example by the arrow 68. The magnetic developer material nap thus can be moved or transported around the shell 54, into and through the extended development nip 56 where it contacts and develops latent images of the surface 12.

Unfortunately however, in a development apparatus in which the extended development nip 56 is formed in a generally horizontal orientation, the magnetic developer material nap must first be moved in a substantially vertical direction from the first portion 54A in order to reach the nip 56 in the top and second portion 54B. Such substantially vertical movement of the nap ordinarily will tend to experience an undersirable rollback before reaching the top-located extended shoulder section 67A for example on an entrance side of the nip 56 as shown. Such an undesirable rollback is due in part to the effect of gravity, and in part to the weakening strength of the first magnetic field of the core magnets 62 at and around the remote extended shoulder section. In any case, such a rollback detrimentally affects the consistency and thickness of the magnetic developer material nap reaching and moving over the shoulder section in order to enter the development nip 56.

In accordance with the present invention, the development apparatus 30 further comprises a transport assist member consisting of a second magnetic member 80 that is mounted at a desired point 82 within the space defined by the non-magnetic shell 54 about the core 52. The transport assist magnet 80 is preferably a weak permanent magnet which generates a second magnetic field at and about such a desired point 82. The second magnetic field therefore acts in addition to the first magnetic field at and about the point 82, thereby creating a resultant and stronger magnetic field thereabout. As a result, a magnetic field strength gradient is created between such point 82 and other adjacent locations within the non-magnetic shell 54. As shown, the point 82 is preferably situated immediately adjacent the nip entrance side shoulder section 67A and hence towards the top of the non-magnetic shell 54 as mounted in a reproduction apparatus 10. As such, the effect of the magnetic field strength gradient created by the transport assist magnet 80 will be to pull and assist the upward movement of the magnetic developer material as it is being transported vertically by the rotating magnets 62 from the bottom portion 54A towards the top and nip-forming portion 54B of the non-magnetic shell 54. The pulling and assisting effect of the magnetic member 80 should be such as to substantially prevent any gravitationally-induced rollback tendency in the developer material nap being transported thus.

In accordance with another aspect of the present invention, when the developer material D consists of toner and magnetic carrier particles, the transport assist magnet 80 additionally acts from its top side, that is, towards the nip side thereof, to attract or recapture, onto the shell 54, any magnetic carrier particles undesirably transferring to the image-bearing surface 12. Such recaptured carrier particles are then held onto the shell 54 and moved by the rotating core magnets 62 back towards the sump area of the development apparatus 30. Accordingly, a second such transport assist magnetic member 84 can therefore be mounted on the exit side of the nip 56 for similarly recapturing carrier particles from the image-bearing surface. Utilization of a pair of transport assist magnets 80 and 84 as such, of course, also permits flexibility in changing the direction of transportation (clockwise or counterclockwise) of developer material D from the sump into and through the nip 56.

Furthermore, the magnetic development brush 50 may also include magnet keepers 84A, 84B which are mounted so as to lie within the first magnetic strength region of the first magnetic field of the core magnets 62, and within the remote areas of the extended shoulder sections 67A, 67B. The magnet keepers 84A, 84B, as is known, are each comprised of a magnetizable material, for example, iron or the like, that exhibits ferromagnetism. As such, when located within a magnetic field, such as the first magnetic field of the rotating magnets 62, such a first magnetic field will induce field magnetization in the keepers 84A, 84B, thereby making them act as field magnets. Such field magnets then each exhibit an appropriate auxiliary magnetic field of their own.

Ordinarily, the strength of the first magnetic field within each extended shoulder section 67A, 67B would be weakened by the remoteness of the shoulder section from the core magnets 62. Therefore, the magnetic strength of the first magnetic field within each such shoulder section will not be as great as it is for example in the midpoint of the nip 56 between such shoulder sections 67A, 67B.

However, in the present invention, the auxiliary magnetic field of the magnet keepers 84A, 84B within each shoulder section acts in addition to the weakening first magnetic field to strengthen, enhance, and increase the resultant magnetic field strength within such remote nip extending sections 67A, 67B of the shell 54. As a result, the resultant magnetic field strength in and about the remote sections 67A, 67B can be maintained at substantially the same level as that within the first magnetic strength region of the first magnetic field of the core magnets 62. Maintaining the magnetic field strength, as such, at and about the remote sections 67A, 67B of the extended development nip 56 therefore ensures that the consistent and desirably thick magnetic developer material nap, that is pulled by the transport assist magnet 80 to the entrance side shoulder section 67A, will be maintained about such section 67A, and about the section 67B as the developer material nap is moved over such sections, into and through the nip 56. As a result, high-quality image development can be achieved by ensuring that there is no detrimental rollback of the developer material nap, and by providing means for forming a consistent and desirably thick developer material nap through the extended development nip.

The invention has been described in detail with particular reference to a presently preferred embodiment, but it will be understood that variations and modifications can be effected within the spirit and scope of the invention.

What is claimed is:

1. A development apparatus for developing images on an image-bearing surface using magnetic developer material, the development apparatus comprising:

(a) a housing;

(b) a magnetic development brush having a non-magnetic shell and a magnetic core comprised of a first magnetic member creating a first magnetic field within said non-magnetic shell, said non-magnetic shell defining a first space around said magnetic core and including a first portion, and a second, nip-forming portion for forming a development nip with the image-bearing surface;

(c) means associated with said housing for supplying magnetic developer material to said magnetic development brush;

(d) means associated with said magnetic development brush for causing the supplied magnetic developer material to be transported around said magnetic development brush; and (e) a transport assist means comprised of a second magnetic member mounted at a location within said first space between said non-magnetic shell and said magnetic core for generating a second magnetic field at said location within said non-magnetic shell, said second magnetic field creating a magnetic field strength gradient between said location and other adjacent locations within said non-magnetic shell for assisting the movement of the magnetic developer material over the non-magnetic shell.

2. The development apparatus of claim 1 wherein said non-magnetic shell of said magnetic development brush is located within a top part of said housing for forming a generally horizontal extended development nip with the image-bearing surface.

3. The development apparatus of claim 2 wherein said second, nip-forming portion of said non-magnetic shell is contoured to follow the shape of the image-bearing surface from an entrance side of said development nip to an exit side thereof.

4. The development apparatus of claim 3 wherein said desired spot for mounting said transport assist member is immediately adjacent an entrance side of said development nip so as to assist a vertical movement of magnetic developer material from a section of said first portion of said non-magnetic shell towards said second, nip-forming portion thereof.

5. The development apparatus of claim 3 wherein said contoured second, nip-forming portion of said non-magnetic shell includes extended shoulder sections for increasing the width of said development nip towards entrance and exit sides thereof.

6. The development apparatus of claim 5 including a magnet keeper mounted within at least one of said shoulder sections of said non-magnetic shell for forming a field magnet therein generating a third magnetic field for enhancing and increasing the magnetic strength of a resultant magnetic field about each said shoulder section.

7. The development apparatus of claim 6 wherein said transport assist member is a weak permanent magnet.

* * * * *